US011437746B2

(12) United States Patent
Chen

(10) Patent No.: US 11,437,746 B2
(45) Date of Patent: Sep. 6, 2022

(54) BOARD-END CONNECTOR AND WIRE-END CONNECTOR

(71) Applicant: Sung-Yu Chen, Taichung (TW)

(72) Inventor: Sung-Yu Chen, Taichung (TW)

( * ) Notice: Subject to any disclaimer, the term of this patent is extended or adjusted under 35 U.S.C. 154(b) by 0 days.

(21) Appl. No.: 17/306,961

(22) Filed: May 4, 2021

(65) Prior Publication Data

US 2021/0351531 A1 Nov. 11, 2021

Related U.S. Application Data

(60) Provisional application No. 63/020,551, filed on May 6, 2020.

(51) Int. Cl.
*H01R 12/75* (2011.01)
*H01R 13/642* (2006.01)

(52) U.S. Cl.
CPC ..... *H01R 12/75* (2013.01); *H01R 13/642* (2013.01)

(58) Field of Classification Search
CPC ..... H01R 12/75–13/642; H01R 24/20; H01R 24/28; H01R 24/50
See application file for complete search history.

(56) References Cited

U.S. PATENT DOCUMENTS 6,746,281 B1 * 6/2004 Zhang ..... H01R 12/725 439/637
6,824,429 B2 * 11/2004 Hwang ..... H01R 13/6594 439/607.2
6,832,934 B1 * 12/2004 Zhang ..... H01R 12/7011 439/660

FOREIGN PATENT DOCUMENTS

TW M564273 U 7/2018

* cited by examiner

*Primary Examiner* — Vanessa Girardi
(74) *Attorney, Agent, or Firm* — Li & Cai Intellectual Property Office

(57) ABSTRACT

A board-end connector and a wire-end connector capable of being engaged with each other to form a wire-to-board connector assembly are provided. The board-end connector includes a board-end insulating housing, a plurality of board-end terminals, and a plurality of board-end signal terminals. The board-end insulating housing has a board-end power mating section and a board-end signal mating section. The board-end signal mating section is located on one side of the board-end power mating section and has a long signal slot. The plurality of board-end terminals are accommodated in the board-end power mating section. The plurality of board-end signal terminals are accommodated in the long signal slot of the board-end signal mating section.

30 Claims, 13 Drawing Sheets

BOARD-END CONNECTOR AND WIRE-END CONNECTOR

CROSS-REFERENCE TO RELATED PATENT APPLICATION

This application claims priority to the U.S. Provisional Patent Application Ser. No. 63/020,551 filed on May 6, 2020, which application is incorporated herein by reference in its entirety.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a board-end connector and a wire-end connector, and more particularly to a connector that is capable of simultaneously transmitting power and signal.

BACKGROUND OF THE DISCLOSURE

Electronic products have developed toward miniaturization, resulting in limited space in the electronic products.

For electronic components that are required to be connected to power wires and signal wires (e.g., control signal wires, or detection signal wires, etc.), wire-to-board connectors are conventionally designed to have separate connections, in which a power connector and a signal connector are respectively used for connection and transmission. The power connector is connected to a power wire, and the signal connector is connected to a plurality of signal wires.

A conventional connection process for transmitting power and signal separately is complicated and takes up space, which does not match the recent trend of miniaturization and is time-consuming.

Therefore, how to improve the structural design to allow the wire-to-board connectors to conform to the trend of miniaturization, so as to overcome the above-mentioned deficiencies, has become an issue to be addressed in this technological field.

SUMMARY OF THE DISCLOSURE

In response to the above-referenced technical inadequacies, the present disclosure provides a board-end connector. Also included herein is a connection manner for transmission of power and signal.

In one aspect, the present disclosure provides a board-end connector capable of receiving a wire-end connector that is plugged therein to form a wire-to-board connector assembly. The board-end connector includes a board-end insulating housing, a plurality of board-end terminals, and a plurality of board-end signal terminals. The board-end insulating housing has a board-end power mating section and a board-end signal mating section. The board-end signal mating section is located on one side of the board-end power mating section, and has a long signal slot. The plurality of board-end terminals are accommodated in the board-end power mating section. The plurality of board-end signal terminals are accommodated in the long signal slot of the board-end signal mating section. A distance between any adjacent two of the board-end terminals is greater than a distance between any adjacent two of the board-end signal terminals in the long signal slot.

In another aspect, the present disclosure provides a board-end connector capable of receiving a wire-end connector that is plugged therein to form a wire-to-board connector assembly. The board-end connector includes a board-end insulating housing, a plurality of board-end terminals, and a plurality of board-end signal terminals. The board-end insulating housing has a board-end power mating section and a board-end signal mating section. The board-end signal mating section has a long signal slot. The plurality of board-end terminals are accommodated in the board-end power mating section. The plurality of board-end signal terminals are accommodated in the long signal slot of the board-end signal mating section. The board-end power mating section is divided into at least a first board-end power mating section and a second board-end power mating section. One side of the long signal slot is adjacent to the first board-end power mating section and another side that is opposite to the one side is adjacent to the second board-end power mating section.

In response to the above-referenced technical inadequacies, the present disclosure further provides a wire-end connector. Also included herein is a connection manner for transmission of power and signal.

In one aspect, the present disclosure provides a wire-end connector capable of being plugged into a board-end connector to form a wire-to-board connector assembly. The wire-end connector includes a wire-end insulating housing, a plurality of wire-end terminals, and a plurality of wire-end signal terminals. The wire-end insulating housing has a body base, a wire-end power mating section, and a wire-end signal mating section. The wire-end power mating section extends forwardly from the body base, and the wire-end signal mating section is connected to the body base and located on one side of the wire-end power mating section. The plurality of wire-end terminals are accommodated in the wire-end power mating section. The plurality of wire-end signal terminals are accommodated in the wire-end signal mating section. The wire-end signal mating section has a long accommodating section that extends forwardly from the body base and accommodates at least two of the wire-end signal terminals. A distance between adjacent two of the wire-end terminals is greater than a distance between adjacent two of the wire-end signal terminals in the long accommodating section.

In another aspect, the present disclosure provides a wire-end connector capable of being plugged into a board-end connector to form a wire-to-board connector assembly. The wire-end connector includes a wire-end insulating housing, a plurality of wire-end terminals, and a plurality of wire-end signal terminals. The wire-end insulating housing has a body base, a wire-end power mating section, and a wire-end signal mating section. The wire-end power mating section extends forwardly from the body base, and the wire-end signal mating section is connected to the body base. The plurality of wire-end terminals are accommodated in the wire-end power mating section. The plurality of wire-end signal terminals are accommodated in the wire-end signal mating section. The wire-end power mating section includes a first wire-end power mating section and a second wire-end power mating section, the wire-end signal mating section is located between the first wire-end power mating section and the second wire-end power mating section, and the wire-end signal mating section and the first wire-end power mating section are spaced apart from each other by a first slit.

One of the advantageous effects of the present disclosure is that, the board-end connector and the wire-end connector provided by the present disclosure utilizes the connection manners for combined transmission of power and signal, thereby allowing the mating process to be simplified and saving space to match the current trend of miniaturization.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
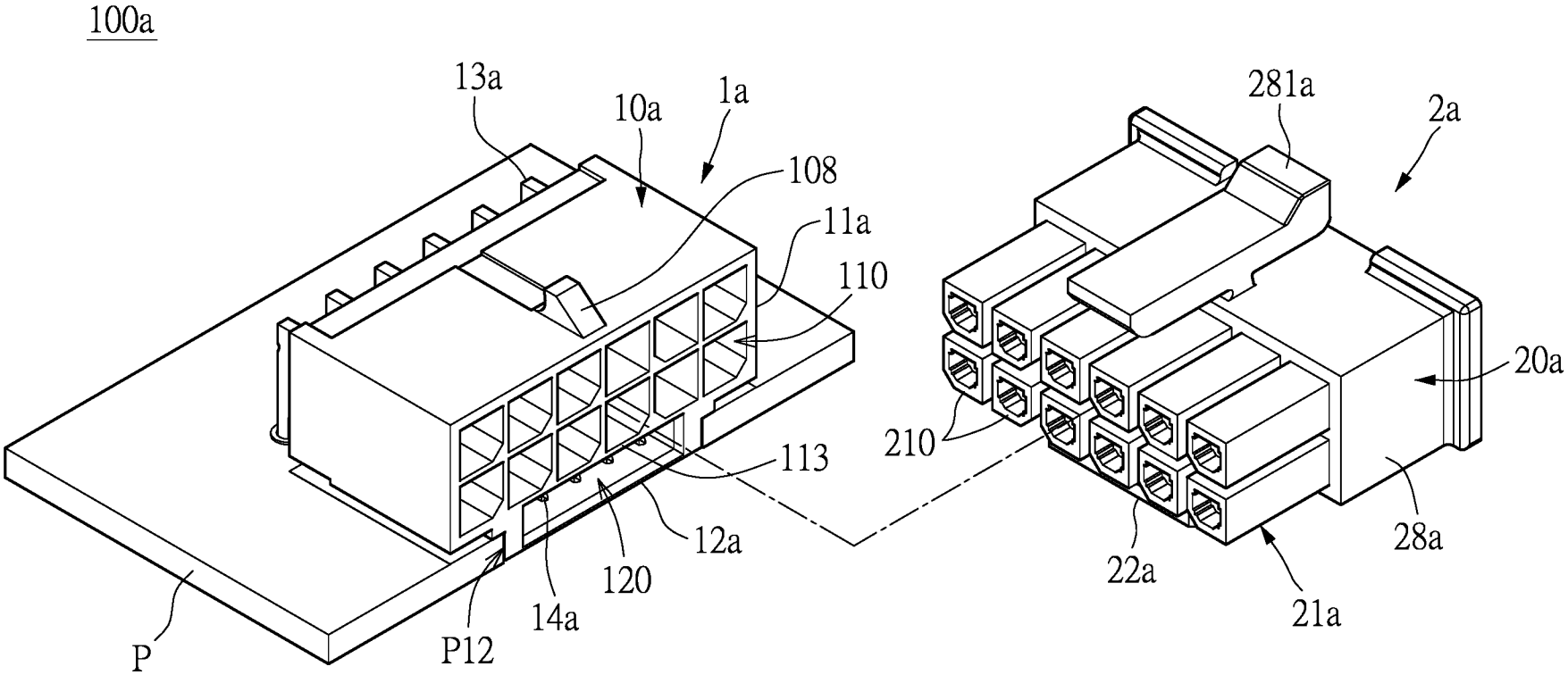
FIG. 1 is an exploded perspective view of a wire-to-board connector assembly according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIGS. 1 to 4, a first embodiment of the present disclosure provides a wire-to-board connector assembly 100*a*, which includes a board-end connector 1*a* and a wire-end connector 2*a*. The wire-end connector 2*a* is capable of being plugged into the board-end connector 1*a* to form the wire-to-board connector assembly 100*a*. The board-end connector 1*a* includes a board-end insulating housing 10*a*, a plurality of board-end terminals 13*a*, and a plurality of board-end signal terminals 14*a*. The wire-end connector 2*a* includes a wire-end insulating housing 20*a*, a plurality of wire-end terminals 23*a*, and a plurality of wire-end signal terminals 24*a*.

The board-end insulating housing 10*a* has a board-end power mating section 11*a* and a board-end signal mating section 12*a*, in which the board-end signal mating section 12*a* is located on one side of the board-end power mating section 11*a* and has a long signal slot 120. The board-end terminals 13*a* are accommodated in the board-end power mating section 11*a*. Specifically, in this embodiment, the board-end power mating section 11*a* has a plurality of independent slots 110, a quantity of the independent slots 110 corresponds to a quantity of the board-end terminals 13*a* (i.e., the quantity of the independent slots 110 is equal to or larger than that of the board-end terminals 13*a*), and each of the board-end terminals 13*a* is accommodated in one of the independent slots 110. The plurality of board-end signal terminals 14*a* are accommodated in the long signal slot 120 of the board-end signal mating section 12*a*.

A quantity of the long signal slot 120 in this embodiment is one. However, the present disclosure is not limited thereto, and the long signal slot can be divided into two or more smaller elongated signal slots.

In this embodiment, a distance W1 between any adjacent two of the board-end terminals 13*a* is greater than a distance W2 between any adjacent two of the board-end signal terminals 14*a* in the long signal slot 120. A connection status of the wire-end connector 2*a* connecting to the board-end connector 1*a* can be transmitted to the board-end signal terminals 14*a* through the wire-end signal terminal(s) 24*a*.

In this embodiment, the board-end terminals 13*a* are arranged in two lines, and the wire-end terminals 23*a* are arranged in one line. However, the present disclosure is not limited thereto. The board-end terminals 13*a* and the wire-end terminals 23*a* can be arranged in an M×N matrix, respectively, and M and N are both positive integers and N is greater than or equal to 2. Furthermore, in this embodiment, distances D1 between any two adjacent lines of M lines (traverse lines, or called rows) are each the same, and are also the same as distances W1 between any two adjacent lines of N lines (vertical lines, or called columns).

In the present embodiment, the wire-end insulating housing 2*a* has a body base 28*a*, a wire-end power mating section 21*a*, and a wire-end signal mating section 22*a*. The wire-end power mating section 21*a* extends forwardly from the body base 28*a*, and the wire-end signal mating section 22*a* is connected to the body base 28*a* and located on one side of the wire-end power mating section 21*a*. The plurality of wire-end terminals 23*a* are accommodated in the wire-end power mating section 21*a*. The plurality of wire-end signal terminals 24*a* are accommodated in the wire-end signal mating section 22*a*. When the wire-end insulating housing 2*a* is plugged into the board-end connector 1*a*, the wire-end power mating section 21*a* is plugged into the board-end power mating section 11*a* to complete a power connection, and the wire-end signal mating section 22*a* is plugged into the board-end signal mating section 12*a* to complete a signal connection. A top surface of the body base 28*a* has a locking arm 281*a*, a top surface of the board-end power mating section 11*a* has a hook 108, and the locking arm 281*a* is locked to the hook 108.

The wire-end power mating section 21 includes a plurality of terminal accommodating sections 210 (i.e., terminal barrels) that are independent from each other, and each of the terminal accommodating sections 210 accommodates one of the wire-end terminals 23*a*. At least two adjacent terminal barrels have different terminal surface shapes. For example, two adjacent ones of the terminal barrels have terminal surface shapes that have corners chamfered in different directions, while terminal surface shapes of the rest of the terminal barrels are rectangular and without any chamfered corner. Or, one of the terminal barrels has a terminal surface shape having a chamfered corner, and terminal surface shapes of the rest of the terminal barrels are rectangular and without any chamfered corner. Therefore, an anti-misinsertion function can be provided.

Figure 2:
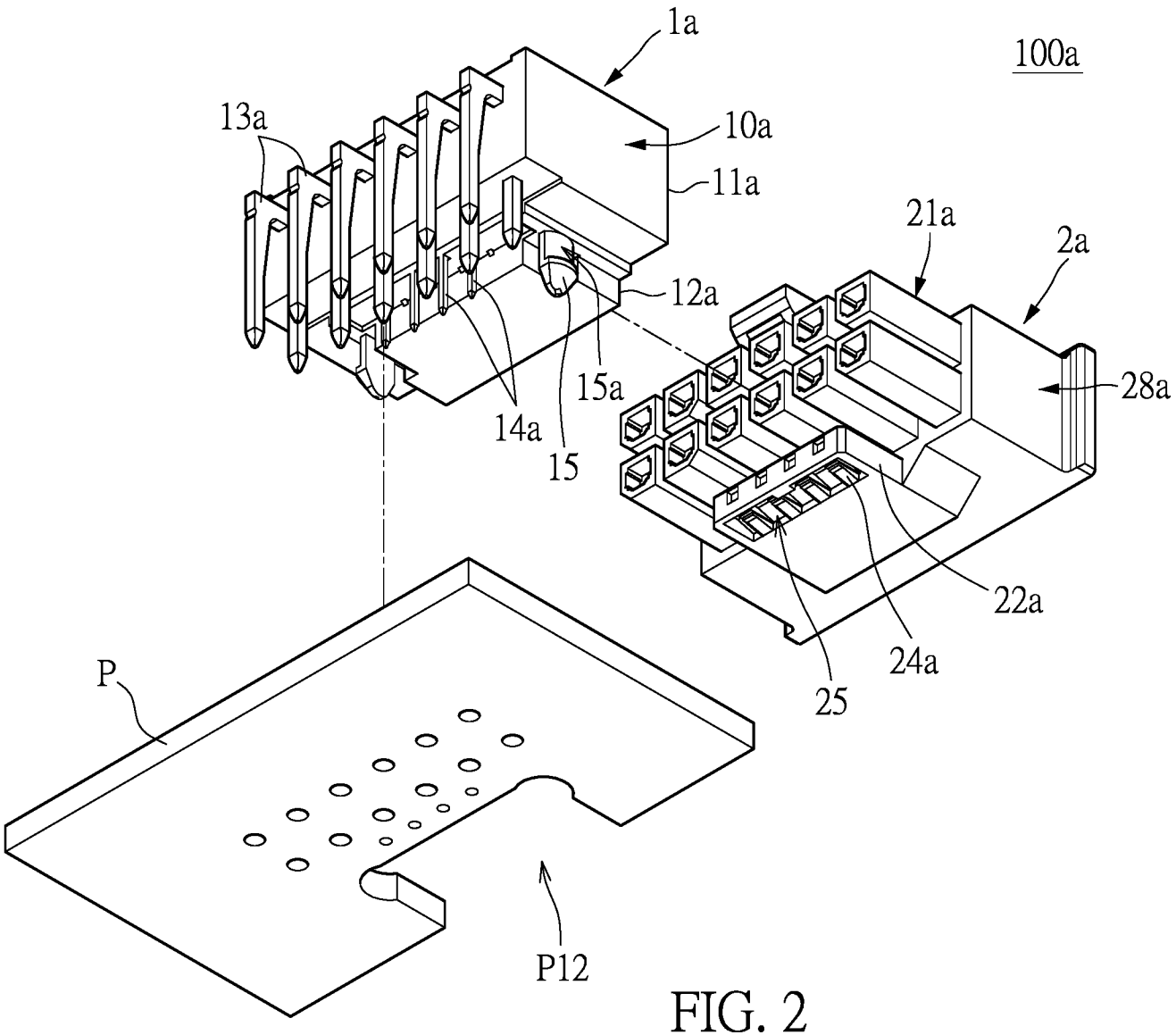
FIG. 2 is another exploded perspective view of the wire-to-board connector assembly according to the first embodiment of the present disclosure.

As shown in FIG. 2, a length of the wire-end signal mating section 22*a* that protrudes from the body base 28*a* is less than a length of the wire-end power mating section 21*a* that protrudes from the body base 28*a*. In other words, a free terminal surface of the wire-end signal mating section 22*a* is located behind a free terminal surface of the wire-end power mating section 21*a*. One side of the wire-end signal mating section 22*a* has an open groove 25 for positioning the wire-end signal terminals 24*a*. As shown in FIG. 2, the open groove 25 is located on a long side of the wire-end signal mating section 22*a*, so that positioning sections (e.g., outwardly biased positioning arms) of the wire-end signal terminals 24*a* are limited from moving backward, so as to achieve the positioning effect. Furthermore, when one of the wire-end signal terminals 24*a* is damaged and is required to be replaced, the positioning effect of the damaged wire-end signal terminals 24*a* can be released through the open groove 25, so that the damaged wire-end signal terminals 24*a* can be removed from the wire-end mating section 22*a* and be replaced.

In addition, at least one of the board-end terminals 13*a* is used for transmitting electric currents greater than or equal to 1 ampere, and the board-end signal terminals 14*a* are used for transmitting electric current signals less than 1 ampere.

As shown in FIG. 1, the board-end power mating section 11*a* is connected to the board-end signal mating section 12*a*, the board-end power mating section 11*a* has a plurality of independent slots 110, and at least one of the independent slots 110 and the long signal slot 120 have a common wall 113.

Figure 4A:
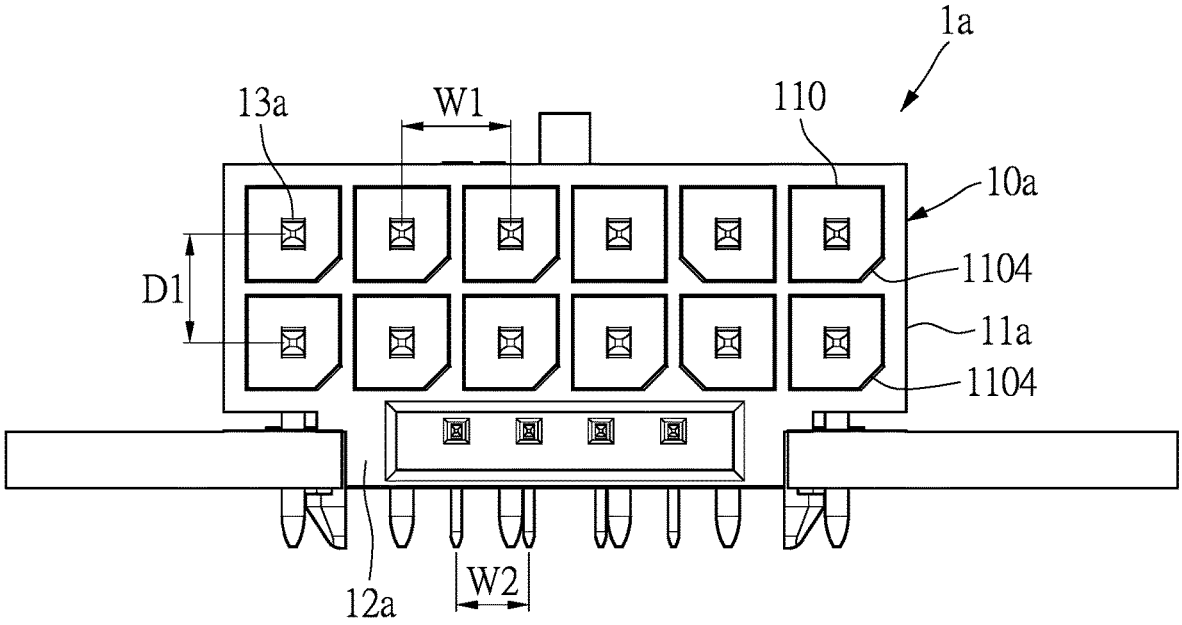
FIG. 4A is a front view of a board-end connector according to the first embodiment of the present disclosure.
Figure 4B:
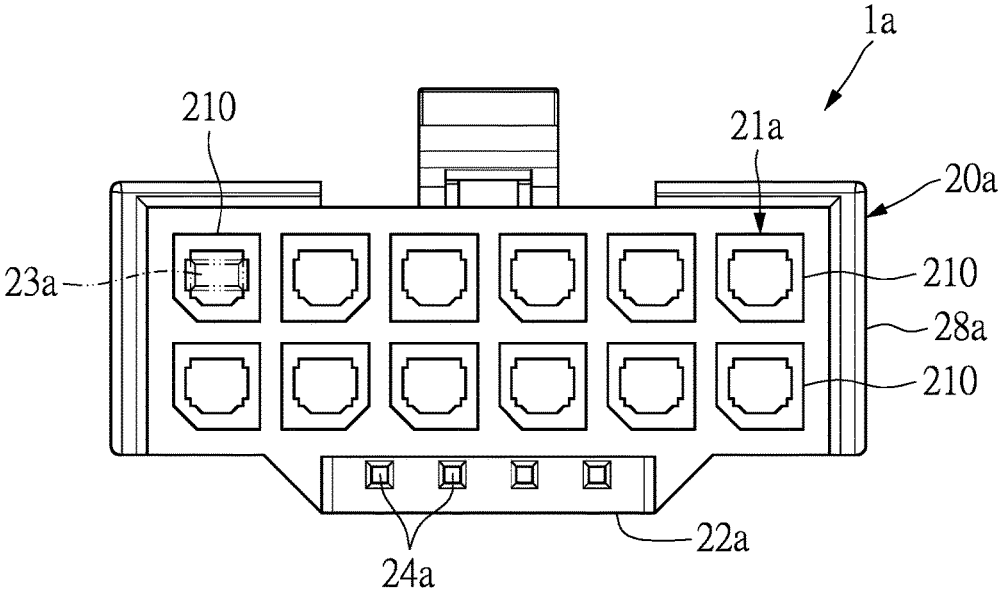
FIG. 4B is a front view of a wire-end connector according to the first embodiment of the present disclosure.

In addition, as shown in FIG. 4A, the board-end power mating section 11*a* of this embodiment has the plurality of independent slots 110, and terminal surfaces of the independent slots 110 are mostly square shaped, and at least one of the terminal shapes of the independent slots 110 has a chamfered corner 1104 (i.e., some of the terminal shapes are square and have chamfered corners).

Figure 3:
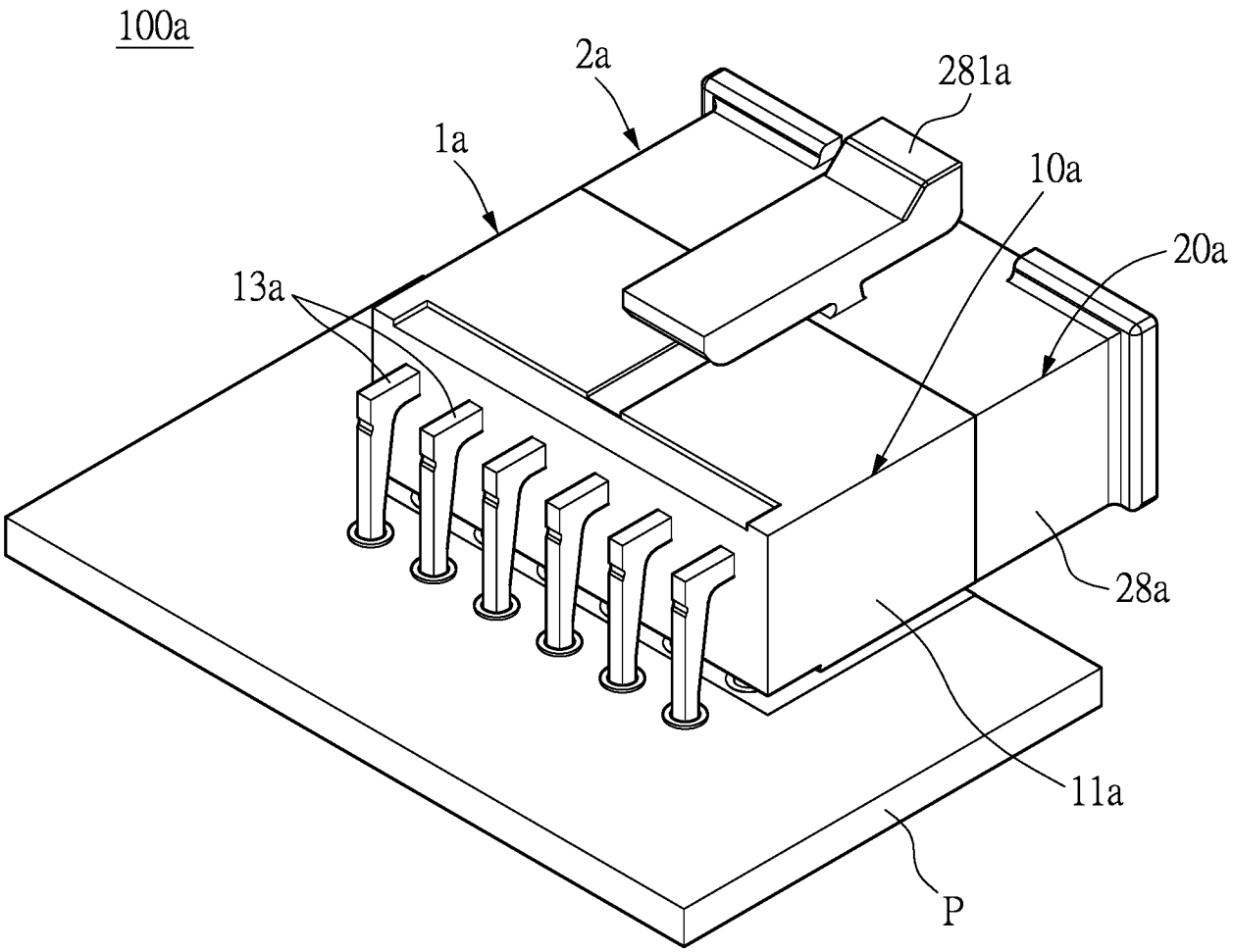
FIG. 3 is an assembled perspective view of the wire-to-board connector assembly according to the first embodiment of the present disclosure.

As shown in FIG. 2 and FIG. 3, in this embodiment, the wire-to-board connector assembly 110*a* further includes a circuit board P. In this embodiment, the board-end connector 1*a* is a right angle connector, and the circuit board P is disposed at a bottom surface of the board-end connector 1*a*. Each of the board-end terminals 13*a* have one end that extends out the board-end insulating housing 21*a* and is fixed to the circuit board P. Each of the board-end terminals 13*a* is bent, the circuit board P has a through hole P12, and the through hole P12 can be located at an edge of the circuit board P (i.e., as a non-closed hole, the circuit board P being notched) or inside the circuit board P (i.e., as a hole being formed in the circuit board P) for accommodating the board-end signal mating section 12*a*. In other words, the board-end connector 1*a* forms a sink connector.

At least one board positioning section is provided on a side surface of the board-end insulating housing 10*a* that faces the circuit board P. As shown in FIG. 2, a board positioning section 15 is located on one side surface (e.g., a bottom surface) of the board-end insulating housing 10*a* for engaging with the circuit board P, so that a bottom portion of the board-end insulating housing 10*a* abuts against a top surface of the circuit board P. In this embodiment, the board positioning section 15 is a column and has a positioning recessed groove 15*a*. The positioning recessed groove 15*a* is fastened on an edge of the through hole P12, so that the board-end insulating housing 10*a* is fixed to the circuit board P. In this embodiment, a quantity of the board positioning section 15 is two, the two board positioning sections 15 are adjacent to two opposite sides of the board-end signal mating section 12*a*, respectively, and the positioning recessed grooves 15*a* face outward.

However, the shape of the board-end power mating section of the present disclosure is not limited to the description above. For example, the board-end power mating section can also be in the shape of an inverted letter "U", the board-end power mating section can further surround both side surfaces of the board-end signal mating section, and a bottom surface of the board-end power mating section can be flush with a bottom surface of the board-end signal mating section.

Second Embodiment

Figure 5:
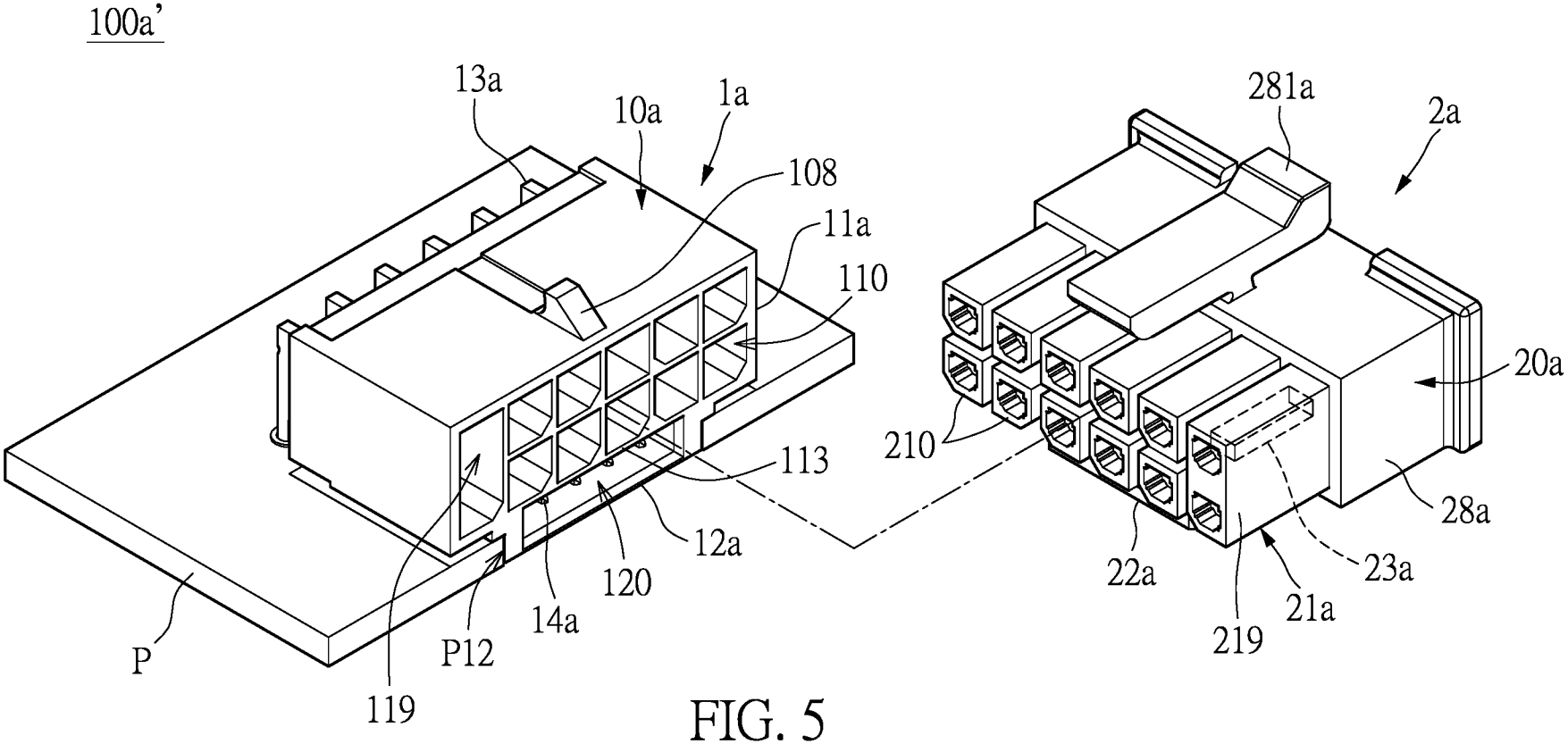
FIG. 5 is an exploded perspective view of the wire-to-board connector assembly according to a second embodiment of the present disclosure.

As shown in FIG. 5, FIG. 5 is a perspective exploded view of a wire-to-board connector assembly 100*a*' according to a second embodiment of the present disclosure. The difference from the first embodiment is that, the board-end power mating section 11*a* has a plurality of independent slots 110 and 119. One of the plurality of independent slots, i.e., the independent slot 119, accommodates at least two of the plurality of board-end terminals 13*a*. In other words, the independent slot 119 is equivalent to a combination of the plurality of independent slots 110, so that an area of an opening (i.e., an area of the hole) of the independent slot 119 is greater than or equal to an area of an opening of the two independent slots 110 each accommodating one single board-end terminal 13*a*. Therefore, the anti-misinsertion function can be provided.

The wire-end signal mating section 22*a* has a long accommodating section, the long accommodating section extends forwardly from the body base 28*a* and accommodates at least two of the wire-end signal terminals 24*a*, the plurality of wire-end signal terminals 24*a* are preferably arranged in a single line, and a distance between adjacent two of the wire-end terminals 23*a* is greater than a distance between adjacent two of the wire-end signal terminals 24*a* in the long accommodating section.

Third Embodiment

Figure 6:
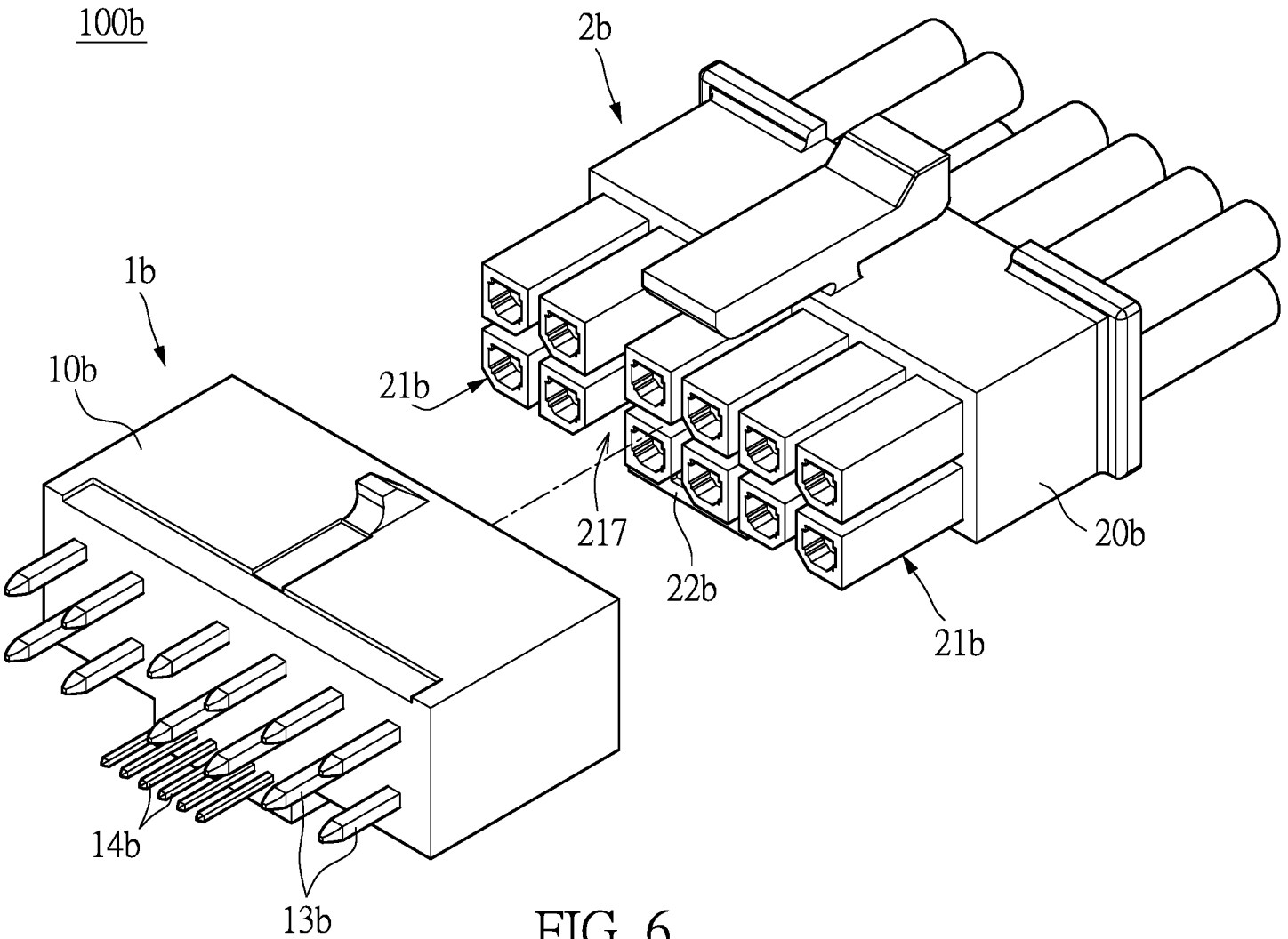
FIG. 6 is an exploded perspective view of the wire-to-board connector assembly according to a third embodiment of the present disclosure.
Figure 7:
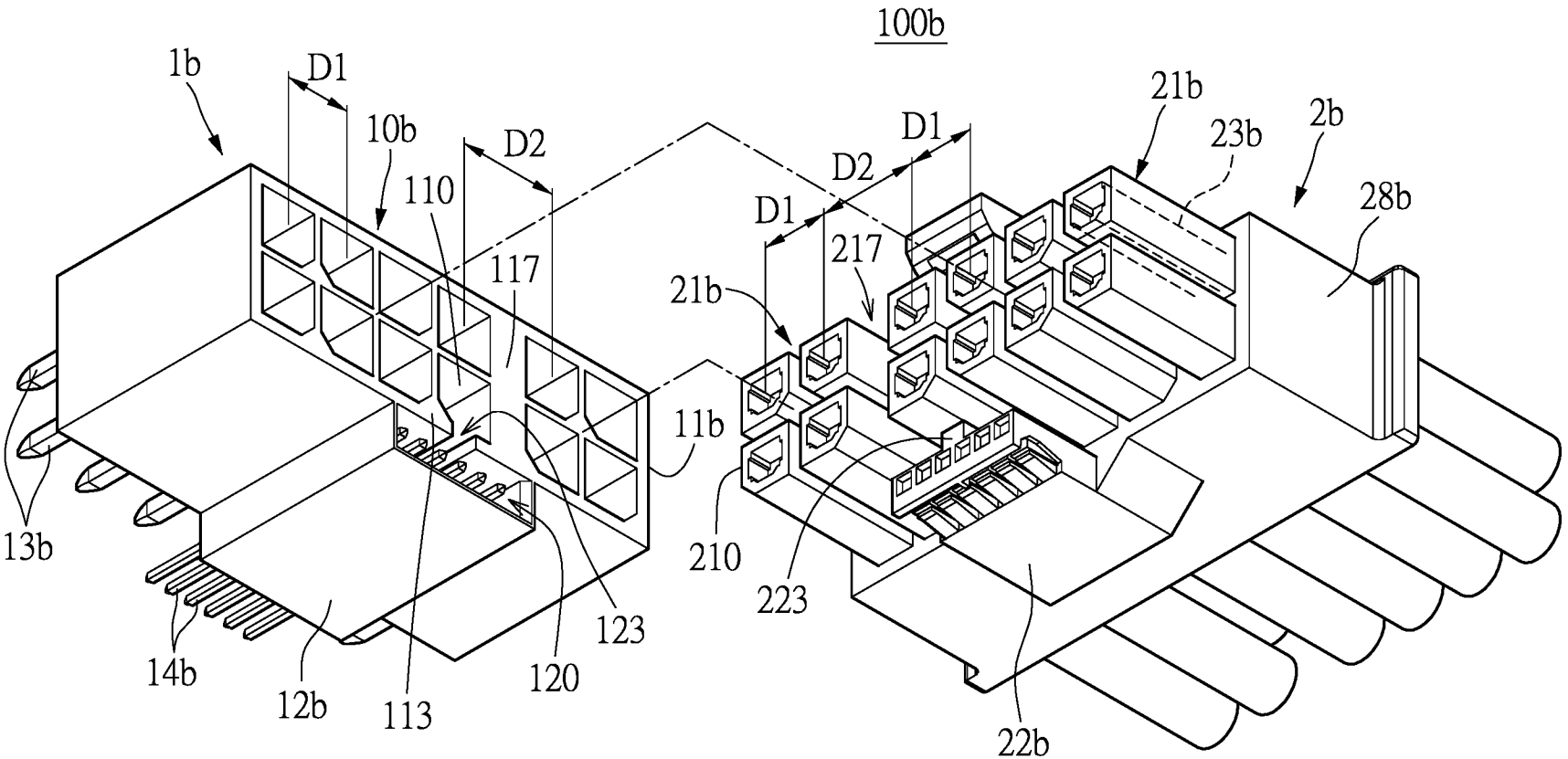
FIG. 7 is another exploded perspective view of the wire-to-board connector assembly according to the third embodiment of the present disclosure.

In FIG. 6 and FIG. 7, a wire-to-board connector assembly 100*b* of this embodiment is shown. Similar to the previous embodiment, a board-end power mating section 11*b* of a board-end connector 1*b* is connected to a board-end signal mating section 12*b*. The board-end power mating section 11*b* has the plurality of independent slots 110, and at least one of the independent slots 110 and the long signal slot 120 have a common wall 113. In this embodiment, the common wall 113 has at least one positioning groove 123. In other words, at least one of the plurality of independent slots 110 is in communication with the long signal slot 120. The common wall 113 and the positioning groove 123 can also provide the anti-misinsertion function.

Correspondingly, the wire-end insulating housing 20*b* of the wire-end connector 2*b* has a body base 28*b*, a wire-end power mating section 21*b*, and a wire-end signal mating section 22*b*. The wire-end power mating section 21*b* extends forwardly from the body base 28*b*, and the wire-end signal mating section 22*b* is connected to the body base 28*b* and located on one side of the wire-end power mating section 21*b*. The wire-end power mating section 21*b* includes the plurality of terminal accommodating sections 210 (or terminal barrels) that are independent from each other, and each of the plurality of terminal accommodating sections 210 accommodates one of the plurality of wire-end terminals 23*b*. In cooperation with the positioning groove 123, a long side of the wire-end signal mating section 22*b* has a positioning member 223 that is connected to one of the terminal accommodating sections 210 of the wire-end power mating section 21*b*. In other words, one of the terminal barrels (i.e., the terminal accommodating sections 210) of the wire-end power mating section 21*b* is adjacent to the wire-end signal mating section 22*b*, and the wire-end signal mating section 22*b* extends forwardly from the body base 28*b* and is connected to a portion of the terminal barrels by means of the positioning member 223.

The plurality of board-end terminals 13*b* of this embodiment are arranged in a 2×6 (M×N) matrix. A distance between two adjacent lines of the N lines (vertically arranged) is D1, a distance between certain two adjacent lines of the N lines is D2, and D2 is greater than D1. Correspondingly, the plurality of wire-end terminals 23*b* are also arranged in a 2×6 (M×N) matrix. N is an integer greater than or equal to 2, and preferably, M is also an integer greater than or equal to 2. A distance between two adjacent lines of the N lines is D1, a distance between another two adjacent lines of the N lines is D2, and D2 is greater than D1.

For example, the board-end power mating section 11*b* includes a first board-end power mating section (2×2) and a second board-end power mating section (2×4), and a thick dividing wall 117 is deposited there-between. This structure provides the anti-misinsertion function. The wire-end power mating section 21*b* is also divided into a first wire-end power mating section and a second wire-end power mating section by a wide slit 217. The first wire-end power mating section has the terminal barrels arranged in a 2×2 matrix, and the second wire-end power mating section has the terminal barrels arranged in a 2×4 matrix. Two adjacent ones of the wire-end terminals located in the first wire-end power mating section have a first distance D1 defined therebetween. Adjacent two of the wire-end terminals respectively belonging to the first wire-end power mating section and the second wire-end power mating section have a second distance D2 defined therebetween, and the first distance D1 is not equal to the second distance D2.

From another perspective, the first wire-end power mating section accommodates a first portion of the wire-end terminals (arranged in a 2×2 matrix, i.e., four wire-end terminals), the second wire-end power mating section accommodates a second portion of the wire-end terminals (arranged in a 2×4 matrix, i.e., eight wire-end terminals), and a quantity of the wire-end terminals of the second portion is greater than a quantity of the wire-end terminals of the first portion.

Each of the board-end terminals 13*b* has one end that extends rearwardly from the board-end insulating housing 10*b*, so the board-end terminals 13*b* are in a linear shape. The circuit board (not shown in the figures) of this embodiment is disposed on a rear end of the board-end connector 1*b* in an upright orientation. In addition, a plurality of board-end signal terminals 14*b* are also in a linear shape and extend rearwardly in a straight manner.

Fourth Embodiment

Figure 8:
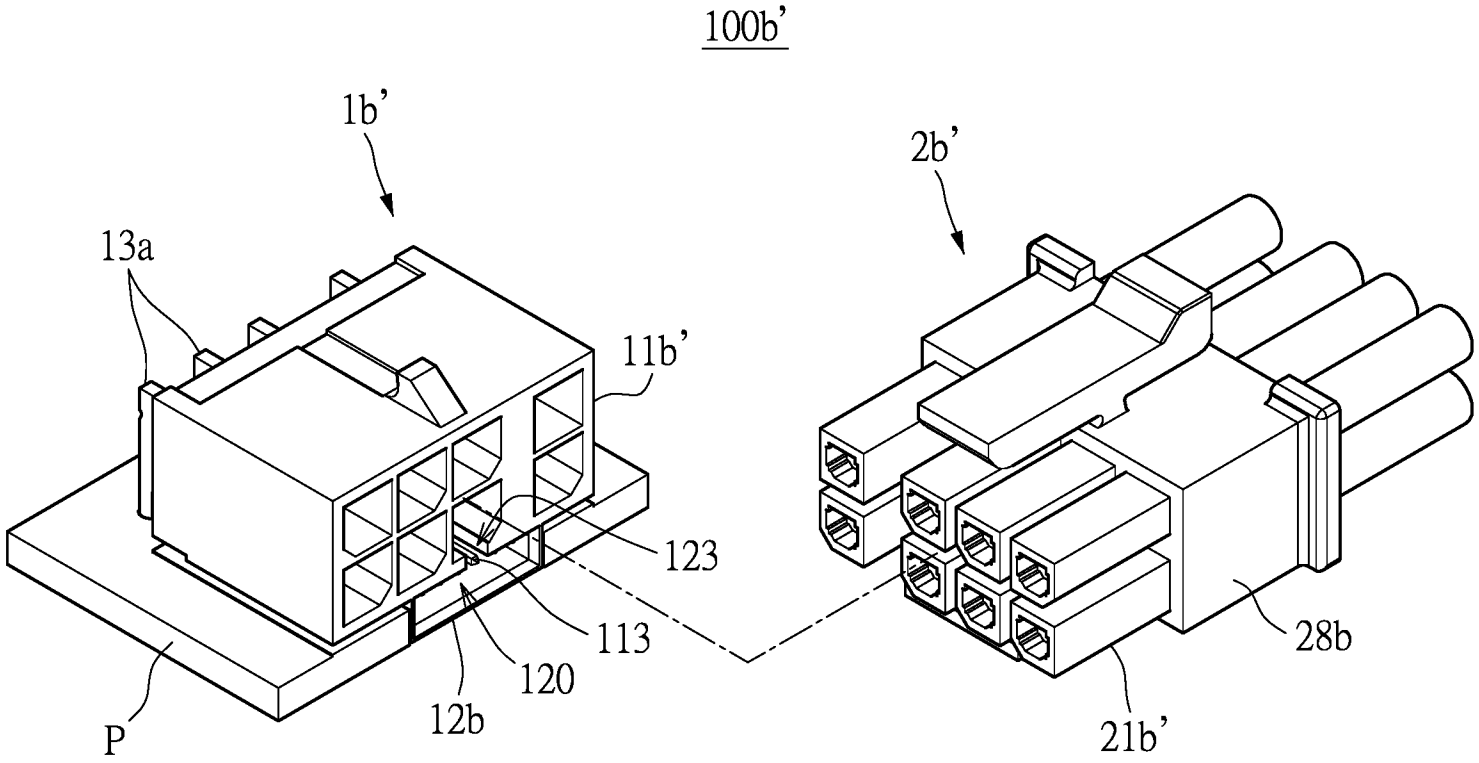
FIG. 8 is an exploded perspective view of the wire-to-board connector assembly according to a fourth embodiment of the present disclosure.
Figure 9:
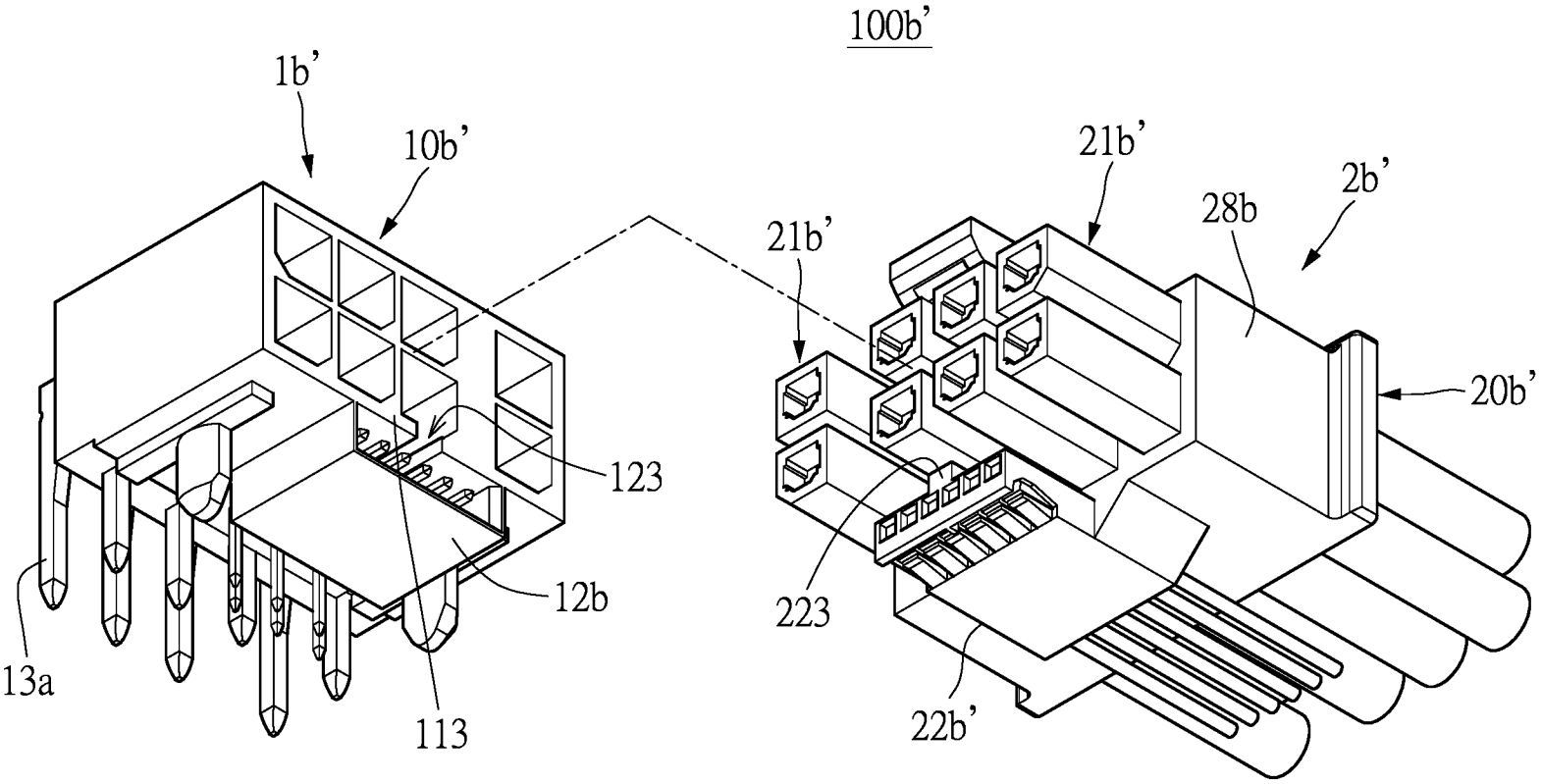
FIG. 9 is another exploded perspective view of the wire-to-board connector assembly according to the fourth embodiment of the present disclosure.

As shown in FIG. 8 and FIG. 9, similar to the previous embodiment, a wire-to-board connector assembly 100*b*' includes a board-end connector 1*b*' and a wire-end connector 2*b*'. A board-end power mating section 11*b*' is connected to the board-end signal mating section 12*b*, the board-end power mating section 11*b*' has the plurality of independent slots 110, and at least one of the independent slots 110 and the long signal slot 120 have a common wall 113. In this embodiment, the common wall 113 has the at least one positioning groove 123, so that the at least one of the plurality of independent slots 110 is in communication with the long signal slot 120.

A wire-end insulating housing 20*b*' of the wire-end connector 2*b*' has a body base 28*b*, a wire-end power mating section 21*b*', and a wire-end signal mating section 22*b*'.

In cooperation with the positioning groove 123, a long side of the wire-end signal mating section 22*b*' has a positioning member 223 that is connected to one of the terminal accommodating sections 210 of the wire-end power mating section 21*b*'.

The plurality of board-end terminals 13*a* of this embodiment are arranged in a 2×4 (M×N) matrix. A distance between two adjacent lines of the N lines (vertically arranged) is D1, a distance between certain two adjacent lines of the N lines is D2, and D2 is greater than D1.

Fifth Embodiment

Figure 10:
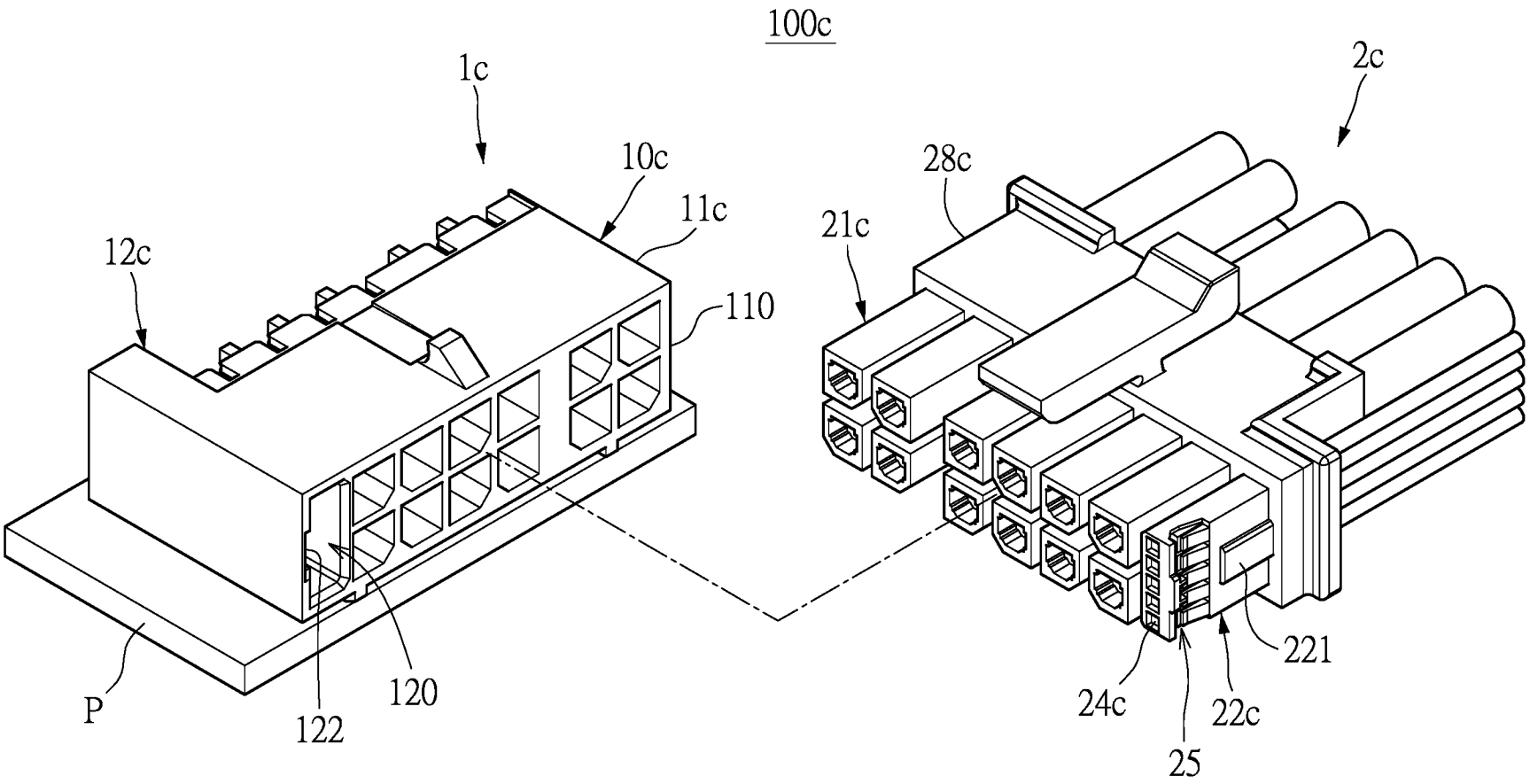
FIG. 10 is an exploded perspective view of the wire-to-board connector assembly according to a fifth embodiment of the present disclosure.

As shown in FIG. 10, a wire-to-board connector assembly 100*c* includes a board-end connector 1*c* and a wire-end connector 2*c*. The board-end connector 1*c* includes a board-end insulating housing 10*c* that can be divided into a board-end power mating section 11*c* and a board-end signal mating section 12*c*. The board-end signal mating section 12*c* has the long signal slot 120. A plurality of the board-end terminals (not shown in the figure) are accommodated in the board-end power mating section 11*c*, and a plurality of the board-end signal terminals (not shown in the figure) are accommodated in the long signal slot 120 of the board-end signal mating section 12*c*. The board-end signal mating section 12*c* is adjacent to a short side of the board-end power mating section 11*c*, and the board-end signal mating section 12*c* of this embodiment is located on the top surface of the circuit board P in an upright orientation and has the same height as the board-end power mating section 11*c*. In other words, a top surface and a bottom surface of the board-end signal mating section 12*c* are flush with a top surface and a bottom surface of the board-end power mating section 11*c*, respectively.

Correspondingly, as shown in FIG. 10, the wire-end connector 2*c* has a body base 28*c*, a wire-end power mating section 21*c*, and a wire-end signal mating section 22*c*. The wire-end power mating section 21*c* extends forwardly from the body base 28*c*, and the wire-end signal mating section 22*c* is connected to the body base 28*c*. The wire-end signal mating section 22*c* is located on a short side of the wire-end power mating section 21*c*. Each of the terminal accommodating sections 210 of the wire-end power mating section 21*c* is substantially a square column, and the wire-end signal mating section 22*c* is a rectangular column. The wire-end signal mating section 22*c* is horizontally aligned with the wire-end power mating section 21*c*, and a top surface and a bottom surface of the wire-end signal mating section 22*c* are flush with a top surface and a bottom surface of the wire-end power mating section 21*c*, respectively. The open groove 25 is provided on one side of the wire-end signal mating section 22*c*, so that the wire-end signal terminal 24*c* can be positioned by the open groove 25. The open groove 25 is located on a long side of the wire-end signal mating section 22*c* away from the wire-end power mating section 21*c*.

The long side of the wire-end signal mating section 22*c* has a positioning member 221. The positioning member 221 is a convex portion. In other words, one convex portion is provided on a side of the wire-end signal mating section 22*c* that is away from the wire-end power mating section 21*c*, i.e., being on the same side as the open groove 25. A positioning groove 122 is correspondingly formed on an outward side of the long signal slot 120.

The board-end terminals and the board-end signal terminals of this embodiment are bent and fixed to the circuit board P by soldering. The circuit board P is located on a bottom surface of the board-end connector 1*c*. However, as described in the previous embodiment, the board-end terminals and the board-end signal terminals may also be in a linear shape, and the circuit board P is located on a rear end of the board-end connector 1*c*.

In this embodiment, the board-end power mating section 11*c* includes a first board-end power mating section (2×2) and a second board-end power mating section (2×4). The wire-end power mating section 21*c* also includes a first wire-end power mating section (2×2) and a second wire-end power mating section (2×4).

Sixth Embodiment

Figure 11:
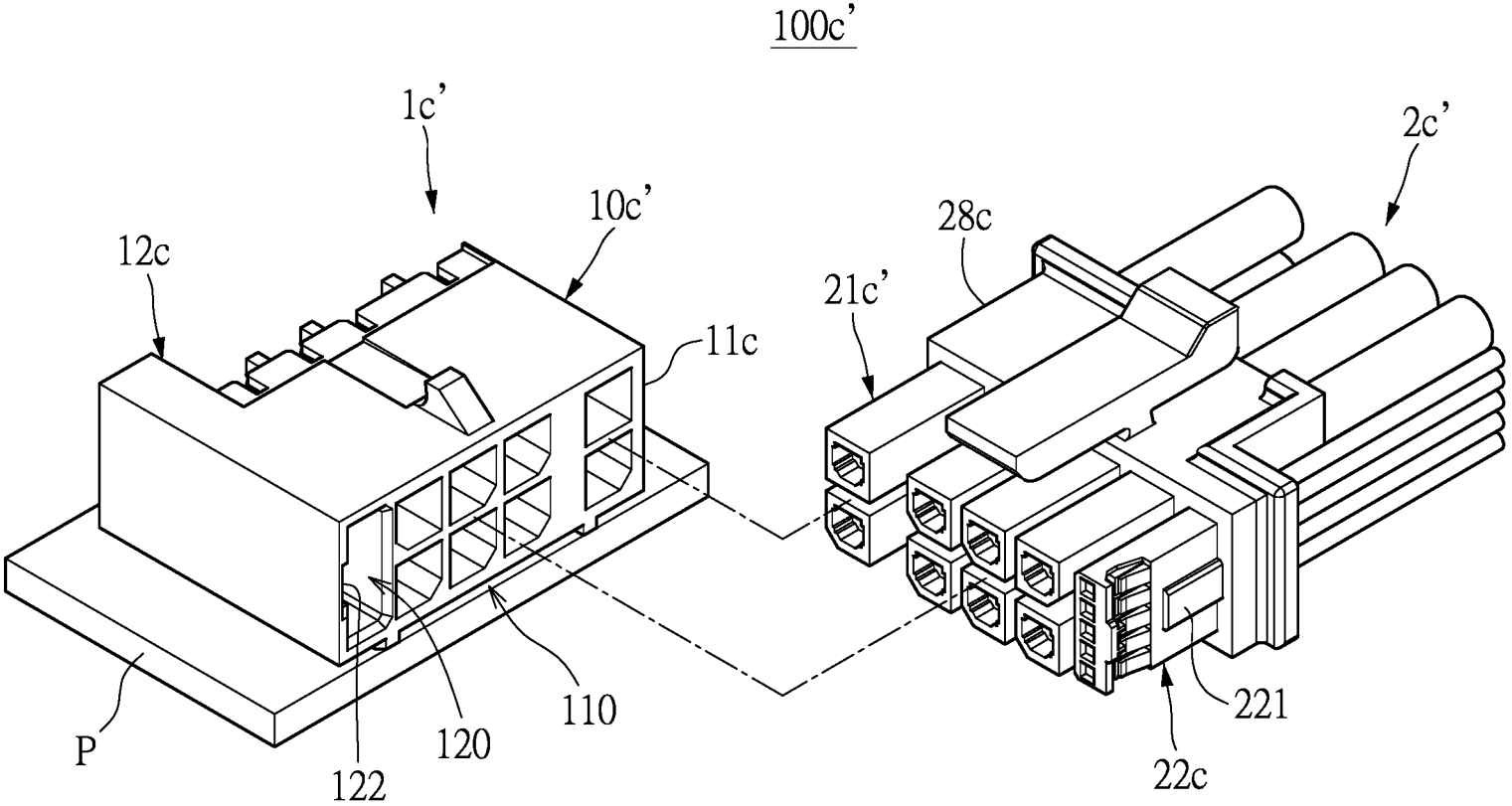
FIG. 11 is an exploded perspective view of the wire-to-board connector assembly according to a sixth embodiment of the present disclosure.

As shown in FIG. 11, a wire-to-board connector assembly 100*c*' includes a board-end connector 1*c*' and a wire-end connector 2*c*'. The difference between this embodiment and the previous embodiment is in the quantity of the board-end terminals. The board-end power mating section 11*c* includes a first board-end power mating section (2×1) and a second board-end power mating section (2×3). A wire-end power mating section 21*c*' also includes a first wire-end power mating section (2×1) and a second wire-end power mating section (2×3).

Other details of this embodiment are similar to those of the previous embodiment, and a board-end insulating housing 10*c*' can be divided into the board-end power mating section 11*c* and the board-end signal mating section 12*c*. The board-end signal mating section 12*c* is adjacent to the short side of the board-end power mating section 11*c*, and the board-end signal mating section 12*c* of this embodiment is located on the top surface of the circuit board P in an upright orientation and has the same height as the board-end power mating section 11*c*. The wire-end signal mating section 22*c*' is located on a short side of the wire-end power mating section 21*c*'. In other words, an area of an opening of the long signal slot 120 is greater than an area of an opening of one of the independent slots 110 of the board-end power mating section 11*c*, and each of the independent slots 110 accommodates a single board-end terminal.

Seventh Embodiment

Figure 12:
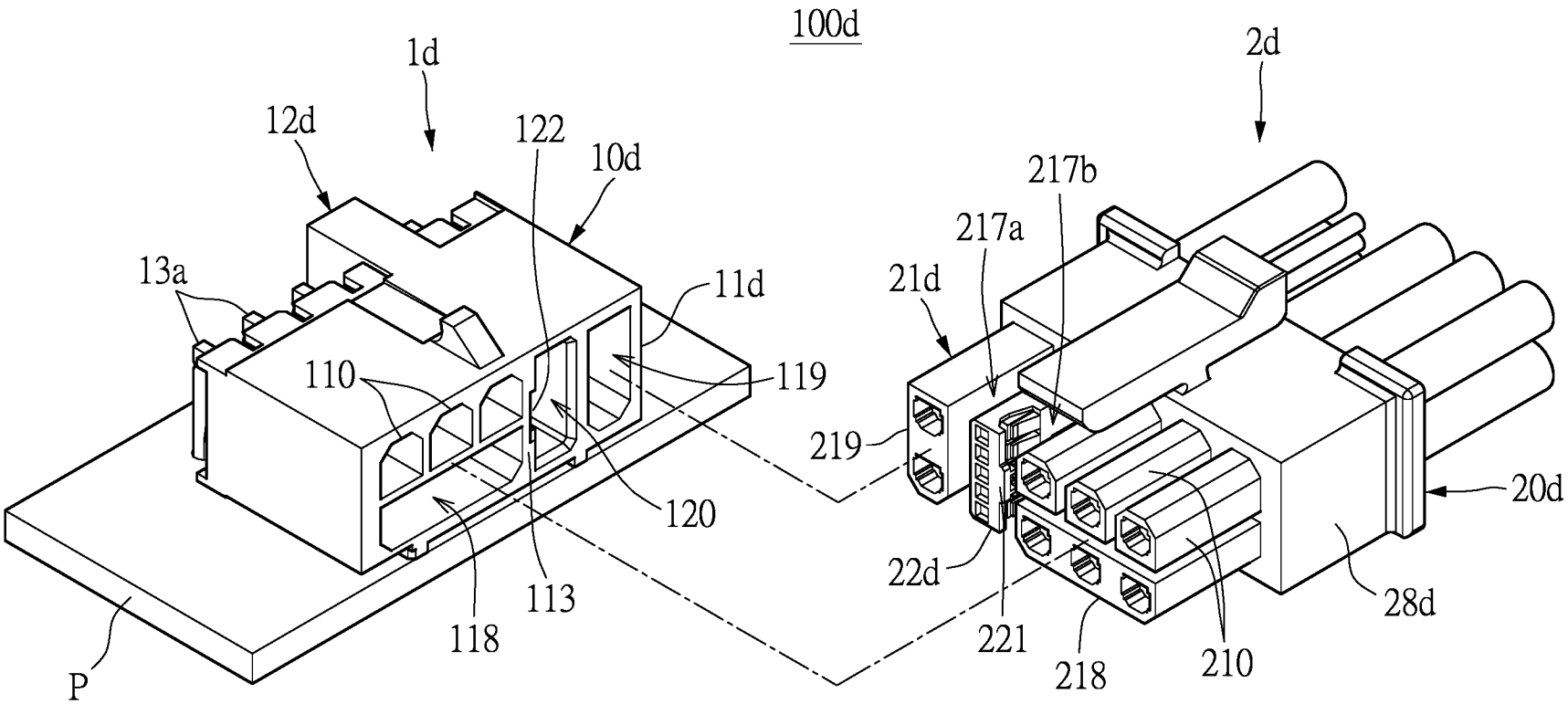
FIG. 12 is an exploded perspective view of the wire-to-board connector assembly according to a seventh embodiment of the present disclosure.

As shown in FIG. 12, in this embodiment, a wire-to-board connector assembly 100*d* includes a board-end connector 1*d* and a wire-end connector 2*d*. The board-end connector 1*d* includes a board-end insulating housing 10*d* that can be divided into a board-end power mating section 11*d* and a board-end signal mating section 12*d*. The board-end signal mating section 12*d* has the long signal slot 120. A plurality of the board-end terminals (not shown in the figure) are accommodated in the board-end power mating section 11*d*, and a plurality of the board-end signal terminals (not shown in the figure) are accommodated in the long signal slot 120 of the board-end signal mating section 12*d*. In this embodiment, the long signal slot 120 accommodates five board-end signal terminals.

In this embodiment, the board-end power mating section 11*d* is divided into a first board-end power mating section and a second board-end power mating section by the long signal slot 120. The first board-end power mating section is located on the right and arranged in a 2×1 matrix, and the second board-end power mating section is located on the left and arranged in a 2×3 matrix. One side of the long signal slot 120 is adjacent to the first board-end power mating section, and the opposite side of the long signal slot 120 is adjacent to the second board-end power mating section.

The second board-end power mating section has a wide slot 118, and the slot 118 accommodates three of the plurality of board-end terminals 13*a*. The first board-end power mating section has the independent slot 119 to accommodate two of the plurality of board-end terminals 13*a*. The configuration of having slots of different widths can be designed to accommodate at least two board-end terminals 13*a*, and can be used as a measure for anti-misinsertion.

The second board-end power mating section and the long signal slot 120 have a common wall 113, and the common wall 113 has at least one positioning groove 122.

A height of the long signal slot 120 is substantially the same as a height of the independent slot 119 of the first board-end power mating section. A distance between two adjacent ones of the board-end terminals 13*a* is greater than a distance between two adjacent ones of the board-end signal terminals in the long signal slot 120.

The wire-end insulating housing 20*d* has a body base 28*d*, a wire-end power mating section 21*d*, and a wire-end signal mating section 22*d*. The wire-end power mating section 21*d* includes a plurality of terminal accommodating sections that are independent from each other, and the terminal accommodating sections include a first terminal accommodating section 219 and a second terminal accommodating section. The first terminal accommodating section 219 accommodates two of the plurality of wire-end terminals (not shown in the figure), and is arranged in a 2×1 matrix. The second terminal accommodating section is arranged in a 2×3 matrix, and includes three independent terminal accommodating sections 210 and a wide elongated terminal accommodating section 218. The long terminal accommodating section 218 accommodates three of the plurality of wire-end terminals (not shown in the figure).

From another perspective, the wire-end power mating section 21*d* includes a first wire-end power mating section that is arranged in a 2×1 matrix and a second wire-end power mating section that is arranged in a 2×3 matrix. The wire-end signal mating section 22*d* is located between the first wire-end power mating section and the second wire-end power mating section, and the wire-end signal mating section 22*d* and the first wire-end power mating section are spaced apart by a first slit 217*a*. The wire-end signal mating section 22*d* and the second wire-end power mating section are spaced apart by a second slit 217*b*. The wire-end signal mating section 22*d* has a convex portion, i.e., the positioning member 221, on one side of the second slit 217*b*.

Eighth Embodiment

Figure 13:
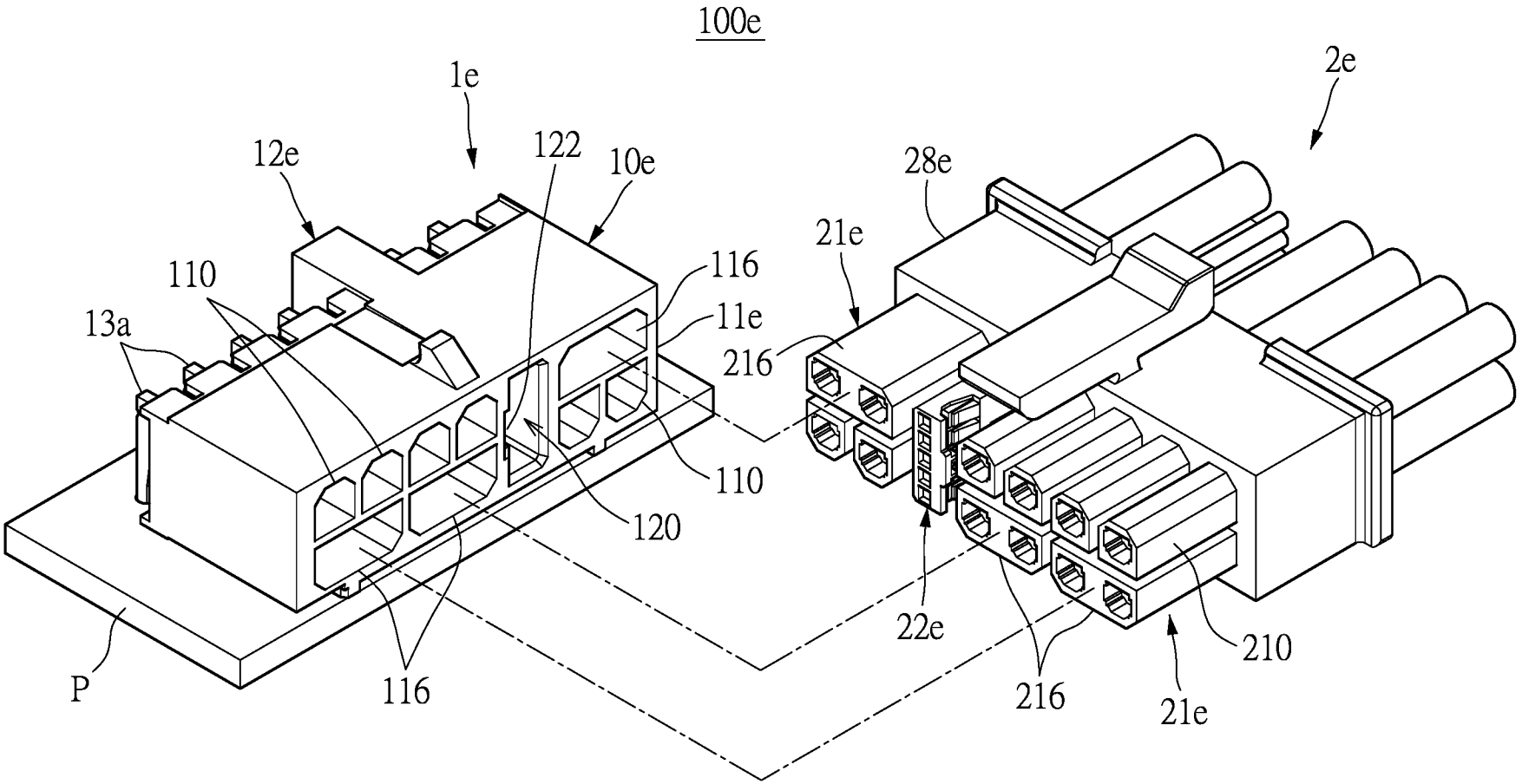
FIG. 13 is an exploded perspective view of the wire-to-board connector assembly according to an eighth embodiment of the present disclosure.

As shown in FIG. 13, a wire-to-board connector assembly 100*e* includes a board-end connector 1*e* and a wire-end connector 2*e*. The board-end connector 1*e* includes a board-end insulating housing 10*e* that can be divided into a board-end power mating section 11*e* and a board-end signal mating section 12*e*. The long signal slot 120 of the board-end signal mating section 12*e* divides the board-end power mating section 11*e* into the first board-end power mating section and the second board-end power mating section. The first board-end power mating section is located on the right and arranged in a 2×2 matrix, and the second board-end power mating section is located on the left and arranged in a 2×4 matrix.

The second board-end power mating section has two horizontally arranged wide slots 116, each accommodating two of the plurality of board-end terminals 13*a*. The first board-end power mating section has one horizontally arranged wide slot 116 that accommodates two of the plurality of board-end terminals 13*a*.

Correspondingly, the wire-end connector 2*e* has a body base 28*e*, a wire-end power mating section 21*e*, and a wire-end signal mating section 22*e*. The wire-end power mating section 21*e* is divided into a first wire-end power mating section that is arranged in a 2×2 matrix and a second wire-end power mating section that is arranged in a 2×4 matrix. The wire-end signal mating section 22*e* is located between the first wire-end power mating section and the second wire-end power mating section.

The first wire-end power mating section has one long terminal accommodating section 216, and the second wire-end power mating section has two long terminal accommodating sections 216. Each of the long terminal accommodating sections 216 accommodates two wire-end terminals (not shown in the figure). In other words, the long terminal accommodating section 216 can be a combination of the plurality of terminal accommodating sections 210, in which adjacent side surfaces of the terminal accommodating sections 210 can either be completely connected to each other (as shown in the figures), or be partially connected (while still achieving the anti-misinsertion function).

BENEFICIAL EFFECTS OF THE EMBODIMENTS

One of the advantageous effects of the present disclosure is that, the board-end connector and the wire-end connector provided by the present disclosure utilizes a connection manner for combined transmission of power and signal, thereby allowing the mating process to be simplified and saving space to match the current trend of miniaturization.

In addition, the present disclosure provides a variety of structural designs for achieving the anti-misinsertion function, e.g., terminal barrels having different terminal surface shapes; terminals having different distances therebetween; at least two board-end terminals being accommodated in the same slot, or at least two wire-end terminals being accommodated in the same terminal barrel; having common walls and positioning grooves configured on the board-end connector and the wire-end connector; and dividing the board-end power mating section into power mating sections of two different sizes, etc.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated.

Alternative embodiments will become apparent to those skilled in the art to which the present disclosure pertains without departing from its spirit and scope.

What is claimed is:

1. A board-end connector capable of receiving a wire-end connector that is plugged therein to form a wire-to-board connector assembly, the board-end connector comprising:

a board-end insulating housing having a board-end power mating section and a board-end signal mating section, wherein the board-end signal mating section is located on one side of the board-end power mating section and has a long signal slot;

a plurality of board-end terminals accommodated in the board-end power mating section; and a plurality of board-end signal terminals accommodated in the long signal slot of the board-end signal mating section;

wherein a distance between any adjacent two of the plurality of board-end terminals is greater than a distance between any adjacent two of the plurality of board-end signal terminals in the long signal slot.

2. The board-end connector according to claim 1, wherein the plurality of board-end terminals are arranged in an M×N matrix, and wherein a distance between two adjacent lines of the N lines is D1, a distance between another two adjacent lines of the N lines is D2, and D2 is greater than D1.

3. The board-end connector according to claim 1, wherein the board-end power mating section has a plurality of independent slots, and one of the plurality of independent slots accommodates at least two of the plurality of board-end terminals.

4. The board-end connector according to claim 1, further comprising a circuit board, wherein one end of each of the board-end terminals extends out the board-end insulating housing and is fixed to the circuit board, each of the board-end terminals is bent, and the circuit board has a through hole for accommodating the board-end signal mating section.

5. The board-end connector according to claim 1, wherein at least one of the board-end terminals is used for transmitting electric currents greater than or equal to 1 ampere, and the board-end signal terminals are used for transmitting electric current signals less than 1 ampere.

6. The board-end connector according to claim 1, wherein the board-end power mating section is connected to the board-end signal mating section, the board-end power mating section has a plurality of independent slots, and at least one of the independent slots and the long signal slot have a common wall.

7. The board-end connector according to claim 6, wherein the common wall has at least one positioning groove.

8. A wire-end connector capable of being plugged into a board-end connector to form a wire-to-board connector assembly, the wire-end connector comprising:

a wire-end insulating housing having a body base, a wire-end power mating section, and a wire-end signal mating section, wherein the wire-end power mating section extends forwardly from the body base, and the wire-end signal mating section is connected to the body base and located on one side of the wire-end power mating section;

a plurality of wire-end terminals accommodated in the wire-end power mating section; and a plurality of wire-end signal terminals accommodated in the wire-end signal mating section;

wherein the wire-end signal mating section has a long accommodating section that extends forwardly from the body base and accommodates at least two of the wire-end signal terminals; wherein a distance between adjacent two of the wire-end terminals is greater than a distance between adjacent two of the wire-end signal terminals in the long accommodating section.

9. The wire-end connector according to claim 8, wherein the wire-end power mating section includes a plurality of terminal accommodating sections that are independent from each other, and the terminal accommodating sections have a first terminal accommodating section for accommodating at least two of the wire-end terminals.

10. The wire-end connector according to claim 8, wherein the wire-end terminals are arranged in an M×N matrix, wherein M and N are both integers greater than or equal to 2, and wherein a distance between two adjacent lines of the N lines is D1, a distance between another two adjacent lines of the N lines is D2, and D1 is greater than D2.

11. The wire-end connector according to claim 8, wherein the wire-end power mating section includes a plurality of terminal accommodating sections that are independent from each other, the terminal accommodating sections accommodate at least one of the wire-end terminals, and the long accommodating section is connected to at least one of the terminal accommodating sections.

12. The wire-end connector according to claim 8, wherein the wire-end power mating section includes a plurality of terminal accommodating sections that are independent from each other, the terminal accommodating sections accommodate at least one of the wire-end terminals, and the wire-end signal mating section extends forwardly from the body base and is spaced apart from an adjacent one of the plurality of terminal accommodating sections by a slit.

13. The wire-end connector according to claim 8, wherein a width of the wire-end signal mating section is smaller than a width of the wire-end power mating section.

14. The wire-end connector according to claim 8, wherein a length of the wire-end signal mating section that protrudes from the body base is less than a length of the wire-end power mating section that protrudes from the body base.

15. The wire-end connector according to claim 8, wherein a free terminal surface of the wire-end signal mating section is located behind a free terminal surface of the wire-end power mating section.

16. The wire-end connector according to claim 8, wherein the wire-end power mating section includes a plurality of terminal barrels, each of the terminal barrels accommodates one of the wire-end terminals, and at least two adjacent ones of the terminal barrels have different terminal surface shapes.

17. The wire-end connector according to claim 8, wherein a convex portion is provided on a side of the wire-end signal mating section that is away from the wire-end power mating section.

18. The wire-end connector according to claim 8, wherein a long side of the wire-end signal mating section has an open groove for positioning the wire-end terminals.

19. The wire-end connector according to claim 8, wherein the wire-end power mating section is divided into a first wire-end power mating section and a second wire-end power mating section, a first distance is defined between adjacent two of the wire-end terminals located in the first wire-end power mating section, a second distance is defined between adjacent two of the wire-end terminals that respectively belong to the first wire-end power mating section and the second wire-end power mating section, and the first distance is not equal to the second distance.

20. The wire-end connector according to claim 19, wherein the first wire-end power mating section accommodates a first portion of the wire-end terminals and the second wire-end power mating section accommodates a second portion of the wire-end terminals, and a quantity of the wire-end terminals of the second portion is greater than a quantity of the wire-end terminals of the first portion.

21. A board-end connector capable of receiving a wire-end connector that is plugged therein to form a wire-to-board connector assembly, the board-end connector comprising:

a board-end insulating housing having a board-end power mating section and a board-end signal mating section, wherein the board-end signal mating section has a long signal slot;

a plurality of board-end terminals accommodated in the board-end power mating section; and a plurality of board-end signal terminals accommodated in the long signal slot of the board-end signal mating section;

wherein the board-end power mating section is divided into at least a first board-end power mating section and a second board-end power mating section; wherein one side of the long signal slot is adjacent to the first board-end power mating section, and another side that is opposite to the one side is adjacent to the second board-end power mating section.

22. The board-end connector according to claim 21, wherein the first board-end power mating section has at least one slot, and the at least one slot accommodates at least two of the board-end terminals.

23. The board-end connector according to claim 21, wherein the first board-end power mating section and the long signal slot have a common wall, and the common wall has at least one positioning groove.

24. The board-end connector according to claim 21, wherein a distance between adjacent two of the board-end terminals is greater than a distance between adjacent two of the board-end signal terminals in the long signal slot.

25. A wire-end connector capable of being plugged into a board-end connector to form a wire-to-board connector assembly, the wire-end connector comprising:

a wire-end insulating housing having a body base, a wire-end power mating section, and a wire-end signal mating section, wherein the wire-end power mating section extends forwardly from the body base, and the wire-end signal mating section is connected to the body base;

a plurality of wire-end terminals accommodated in the wire-end power mating section; and a plurality of wire-end signal terminals accommodated in the wire-end signal mating section;

wherein the wire-end power mating section is divided into a first wire-end power mating section and a second wire-end power mating section, the wire-end signal mating section is located between the first wire-end power mating section and the second wire-end power mating section, and the wire-end signal mating section and the first wire-end power mating section are spaced apart from each other by a first slit.

26. The wire-end connector according to claim 25, wherein the first wire-end power mating section accommodates a first portion of the wire-end terminals and the second wire-end power mating section accommodates a second portion of the wire-end terminals, and a quantity of the wire-end terminals of the second portion is greater than a quantity of the wire-end terminals of the first portion.

27. The wire-end connector according to claim 25, wherein the second wire-end power mating section has a terminal barrel adjacent the wire-end signal mating section, and the wire-end signal mating section extends forwardly from the body base and is connected to a portion of the terminal barrel.

28. The wire-end connector according to claim 25, wherein a distance between two adjacent ones of the wire-end terminals is greater than a distance between two adjacent ones of the wire-end signal terminals.

29. The wire-end connector according to claim 25, wherein the wire-end signal mating section and the second wire-end power mating section are spaced apart from each other by a second slit.

30. The wire-end connector according to claim 29, wherein the wire-end signal mating section has a convex portion on one side of the second slit.

* * * * *